United States Patent [19]

Masaka

[11] Patent Number: 4,682,008

[45] Date of Patent: Jul. 21, 1987

[54] SELF-TEMPERATURE CONTROL TYPE GLOW PLUG

[75] Inventor: Mitusuke Masaka, Saitama, Japan

[73] Assignee: Jidosha Kiki Co., Ltd., Tokyo, Japan

[21] Appl. No.: 836,831

[22] Filed: Mar. 6, 1986

[30] Foreign Application Priority Data

| | | | |
|---|---|---|---|
| Mar. 22, 1985 | [JP] | Japan | 60-55988 |
| Mar. 22, 1985 | [JP] | Japan | 60-55989 |
| Mar. 22, 1985 | [JP] | Japan | 60-55990 |
| Mar. 22, 1985 | [JP] | Japan | 60-55991 |
| Mar. 22, 1985 | [JP] | Japan | 60-55992 |

[51] Int. Cl.[4] ..... H05B 3/00; F02P 19/02

[52] U.S. Cl. ..... 219/270; 219/260; 219/267; 219/552; 219/553; 123/145 A; 123/145 R; 361/264; 361/265; 361/266

[58] Field of Search ..... 219/260, 267, 270, 552, 219/553; 123/145 A, 145 R; 361/264, 265, 266

[56] References Cited

U.S. PATENT DOCUMENTS

| | | | |
|---|---|---|---|
| 4,237,843 | 12/1980 | Page et al. | 123/145 A |
| 4,477,717 | 10/1984 | Walton | 219/267 |
| 4,486,651 | 12/1984 | Atsumi et al. | 219/553 |
| 4,556,780 | 12/1985 | Atsumi et al. | 219/270 |

*Primary Examiner*—E. A. Goldberg
*Assistant Examiner*—Gerald E. Preston
*Attorney, Agent, or Firm*—Blakely, Sokoloff, Taylor & Zafman

[57] ABSTRACT

A self-temperature control type glow plug includes a rod heater held at a front end of a hollow metal holder and having one end extending outside the hollow metal holder. The rod heater includes a heating section made of a conductive ceramic material with a small positive temperature coefficient and a control section made of a conductive ceramic material with a positive temperature coefficient larger than that of the heating section. The heating section is formed integrally with the control section.

20 Claims, 19 Drawing Figures

SELF-TEMPERATURE CONTROL TYPE GLOW PLUG

BACKGROUND OF THE INVENTION

The present invention relates to a glow plug used to preheat a subcombustion or combustion chamber of a diesel engine, and more particularly, to an improvement in a self-temperature control type glow plug with a rod heater for achieving a fast heating function and improving heating characteristics to achieve a prolonged after-glow.

Since a diesel engine generally has poor starting characteristics at low temperatures, a glow plug is mounted in a subcombustion or combustion chamber thereof. A current is supplied to the glow plug to heat it. The heat from the glow plug increases an intake temperature, or is used as an ignition source, so that the starting characteristics of the diesel engine are improved. A typical conventional glow plug is of a sheath type wherein a metal sheath is filled with a refractory insulating powder, and a coil heater of iron chromium, nickel or the like is embedded in the powder. Another typical conventional glow plug is of a ceramic heater type, described in Japanese Patent Prepublication No. 57-41523. The ceramic heater type glow plug has a rod heater prepared by embedding a heater wire of tungsten or the like in a ceramic material. In this type of plug, when compared with the sheath type glow plug which performs indirect heating through the refractory insulating powder and the metal sheath, heat conduction efficiency is improved as are heat conduction characterisitics. The ceramic heater type glow plug need only be heated for a short period of time, thereby improving temperature rise characteristics and satisfying fast-heating glow plug requirements to some extent. Because of these advantages, ceramic heater type glow plugs have become popular in recent years.

Still another conventional glow plug is proposed, as a self-temperature control type glow plug with two heating materials, in Japanese Patent Publication No. 45-11648 and Japanese Patent Prepublication No. 54-109538. In this type of plug, a resistor with a larger positive temperature coefficient (PTC) than the conventional heating wire is connected as an energization power control element in series with the heating wire of the glow plug. Energization power to the heating wire is self-controlled to greatly improve the heating characteristics and prevent overheating of the heater portion of the plug.

However, since only one type of heating wire is embedded inside the conventional ceramic heater glow plug in the same manner as in the conventional sheath type glow plug, some problems occur in energization power control. In order to greatly improve the temperature rise characteristics upon heating of such a ceramic heater, a large current must be supplied to the heater in the initial energization period to quickly heat the heating wire. In this case, the heating wire becomes fused and disconnected, and residual high heat adversely affects the ceramic heater. Therefore, when one type of heating wire is used, power control cannot be satisfactorily performed, thus resulting in poor fast-heating characteristics. Furthermore, fast heating also adversely affects the battery and the electrical circuit. In the worst case, fuses therein are disconnected.

In order to prevent the above problems, a temperature control means must be additionally arranged on the heating wire circuit. As a result, the preheating device including the glow plug inevitably results in high cost. In such a ceramic heater type glow plug, a heating wire of tungsten or the like is embedded in a ceramic heater of silicon nitride or the like. A temperature profile within the heater tends to be nonuniform, reliability of heat-resistance is degraded, and the manufacturing cost is very high. For these reasons, a proper countermeasure must be provided.

A conventional self-temperature control type glow plug with two coils might solve the problems presented by the conventional ceramic heater type glow plug, but some problems on the reliability of the control function and the like are present. In addition, some problems with fast heating, since the self-temperature control type glow plug performs indirect heating through the ceramic material in the same manner as in the sheath type glow plug, are also present. More specifically, in the conventional self-temperature control type glow plug with two different heating materials, a power control resistor is mounted in a holder while the holder is filled with an insulating material such as soluble glass. The power control resistor is connected in series with a heating wire in a sheath. This type of plug has a complex structure, and its assembly is time-consuming and complicated. In addition, it is difficult to properly control the function of the resistor. With such a structure, it is impossible to shorten the desired temperature rise to a period within 7 seconds. Along with the prolongation of a period of energization, i.e., so-called after-glow upon starting of the engine, even though such prolongation is the latest market demand, degradation of the wire material itself is a critical problem.

In particular, in the conventional glow plug of this type, demand has recently arisen for an "after-glow" system which improves starting characteristics of diesel engines and has durability against high-temperature operating conditions required by the widespread use of turbo chargers, and which reduces the cost of the preheating device as a whole. According to such an after-glow system, the energization state of the glow plug is maintained for a predetermined period of time after starting the engine, so that combustion in the engine can be smoothly and properly performed and hence the amount of exhaust gas and noise can be decreased. In order to do this, the after-glow time must be as prolonged as possible. Even after the engine is started, it is usually too cold to be operated in a normal state in cold environmental temperatures, and takes a long period of time to attain a proper idling state. Furthermore, when the engine is cold, idling noise is increased and white smoke is exhausted, due to incomplete fuel combustion. In the worst case, the engine stops. Therefore, the after-glow effect is required to prevent these problems.

SUMMARY OF THE INVENTION

It is, therefore, a principal object of the present invention to provide a diesel engine self-temperature saturation type glow plug which has a fast heating function (i.e., a heater tip can be quickly heated to red), has heating characteristics suitable for a glow plug with appropriate peak and saturation temperatures, has a prolonged after-glow effect, and is of a self-temperature saturation type.

It is another object of the present invention to provide a diesel engine self-temperature saturation type glow plug with high reliability in heat-resistance and mechanical strength, and can be produced in a simple manufacturing process at low cost.

In order to achieve the above objects of the present invention, there is provided a self-temperature control type glow plug wherein a rod heater held at a front end of a hollow metal holder, such that one end of the rod heater extends outside the metal holder, consists of an integral body of a heating section which is made of a conductive ceramic material with a small positive temperature coefficient, and a control section which is made of a conductive ceramic material with a positive temperature coefficient larger than that of the heating section and is connected to the heating section.

Different connection states between the heating section and the control section are given as follows:

(1) A substantially rod-like heating section is connected to a control section along an axial direction thereof;

(2) A control section is formed on the outer surface of the rear end portion of a rod-like heating section through a refractory insulating layer;

(3) A heating section is formed on the outer surface of the front end of a rod-like control section;

(4) A heating section is formed on the outer surface of a refractory insulating cylinder as a base, a control section is formed inside the cylinder, and parts of the heating section and the control section are connected to each other;

(5) A heating section is formed on the outer surface of the front end portion of a refractory insulating layer as a base, and a control section is formed continuous with the heating section; and (6) A heating section is formed on the outer surface of the front end portion, the end face of the front end portion and the inner surface of a refractory insulating cylinder as a base, a control section is formed on the outer surface of the rear end portion, the end face of the rear end portion and the inner surface of the cylinder, and the heating section is insulated from the control section inside the cylinder.

One of the heating and control sections is electrically connected to the holder, and the other is connected directly, or through a metal wire, to an electrode rod held at the rear end of the holder. Among the connection modes, the heating section is exposed to the outer surface of the heater in an inner/outer heating type arrangement and a surface heating type arrangement.

DESCRIPTION OF THE PREFERRED EMBODIMENTS

The present invention will be described in detail with reference to the preferred embodiments in conjunction with the accompanying drawings.

Figure 1:
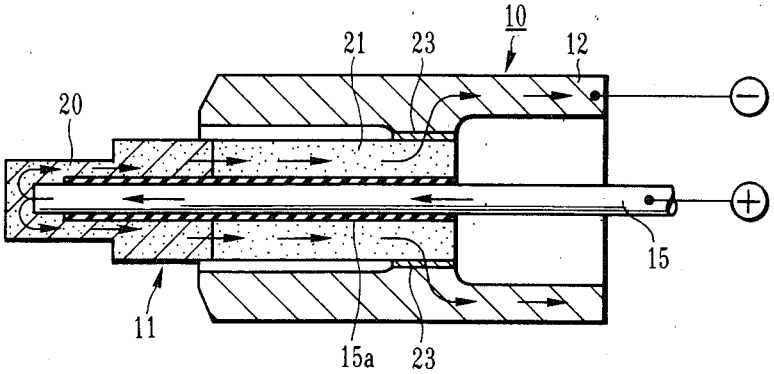
FIG. 1 is an enlarged longitudinal sectional view showing the main part of a self-temperature control type glow plug according to an embodiment of the present invention.
Figure 2:
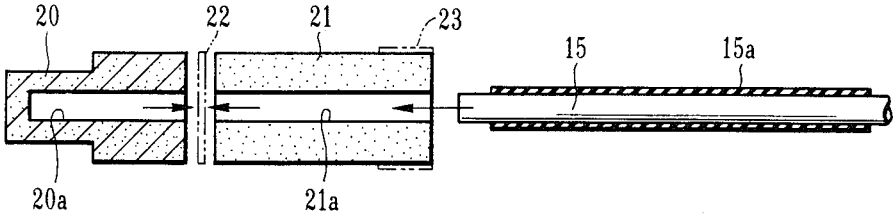
FIG. 2 is an exploded view for explaining a forming state of a rod heater as the major member of the glow plug in FIG. 1.
Figure 3:
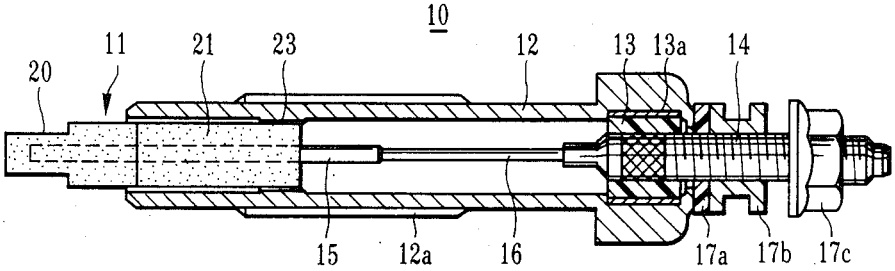
FIG. 3 is a longitudinal sectional view of the self-temperature control type glow plug in FIG. 1.

FIGS. 1 to 3 show a self-temperature control type glow plug according to an embodiment of the present invention. Referring to FIG. 3, the overall structure of a self-temperature control type glow plug 10 will be briefly described. The glow plug 10 includes a rod heater 11 whose front end portion serves as a heater, and a tubular metal holder 12 for holding the heater 11 at its front end. An external connection terminal 14 is concentrically fitted in the rear end portion of the holder 12 through an insulating bush 13 of a synthetic resin or the like. The external connection terminal 14 is connected to an electrode rod 15 through a metal wire 16 such as a flexible wire. The electrode rod 15 is connected to a heating section 20 of the heater 11.

A metal pipe **13*a* is mounted on the outer surface of the insulating bush 13. The metal pipe 13*a* is caulked by a high-pressure force at the rear end portion of the holder 12, and is then deformed, so that the insulating bush 13 is mounted together with the holder 2 with a predetermined mechanical strength, so as to achieve a structure free from temperature influences. This effect can be readily understood from the fact that a conventional plastic insulating bush is subjected to thermal expansion or contraction and is thereby loosened on the holder 12. Reference numerals 17*a*, 17*b*, and 17*c* denote an insulating ring, a fastening nut and an external lead fastening nut, which are threadably engaged with a threaded portion of the rear end portion of the external connection terminal 14. Lead wires from a battery (not shown) are clamped by the nuts 17*b* and 17*c*, so that the external connection terminal 14 is electrically connected to the battery terminal. A threaded portion 12*a* of the outer surface of the holder 12 is threadably engaged with a screw hole formed in a cylinder head of the engine and is electrically grounded. At the same time, the front end of the heater 11** extends inside the subcombustion or combustion chamber.

The reason the external connection terminal 14 is connected to the heater 11 via the metal wire 16 lies in the fact that the heater 11 is mechanically protected against external mechanical forces such as various types of vibration, and a fastening torque, both of which act on the external connection terminal 14. A material of the wire 16 is preferably flexible. However, the terminal arrangement is not limited to the above arrangement. The metal wire 16 may be omitted, and the external connection terminal 14 may be integrally formed with the electrode rod 15.

In the glow plug 10 according to this embodiment, the rod heater 11 held at the front end of the holder 12 consists of a heating section 20 as the front half of the heater 10 and a control section 21 as the rear half thereof, as shown in FIG. 1. The heating section 20 is formed of a conductive ceramic material with a small positive temperature coefficient. The control section 21 is formed of a conductive ceramic material with a positive temperature coefficient larger than that of the heating section 20.

According to this embodiment, unlike in the conventional glow plug wherein the heating wire is embedded in a sheath or in ceramic to constitute an inner heating type glow plug which is not of the fast heating type, the heating section 20 is exposed on the outer surface of the heater 11. At the same time, the control section 21 with a power control function is integrally formed with the heating section 20, thereby providing a self-temperature control function. In addition, the plug's heat-resistance is also reliably provided. According to the rod heater 11 of this embodiment, the heater section 20 is not only exposed on the outer surface of the heater 11 but also extends inside the heater 11. Therefore, the heater of this embodiment can be of an inner/outer heating type, as opposed to the conventional inner-heating-only type glow plug. The advantages of the glow plug of this embodiment are thus apparent from the above description.

The conductive ceramic materials of the heating and control sections 20 and 21 constituting the rod heater 11 are preferably fine ceramic materials such as silicon non-oxides (e.g., $MoSi_2$, $WSi_2$, $RuO_2$, SiC, and $LaCrO_3$) which are physically stable even at a high temperature of about 1,400° C. and have high resistance to heat impact. The conductive materials are therefore appropriately selected from the above materials. It is essential that the positive temperature coefficient of the heating section 20 be smaller than that of the control section 21. However, it is possible to use an identical material for both the sections 20 and 21. For example, 30% or more of TiN can be added to sialon, and TiN-containing sialon of confirmed conductivity (i.e., so-called conductive sialon) can be obtained. When the content of TiN is increased to exceed 30%, its resistance continuously changes. Preferably the content of TiN is varied within the range of 30% to 50%.

In the embodiment shown in FIG. 1, the volume of the heating section 20 in the rod heater 11 is the same as that of the control section 21 therein. However, the present invention is not limited to this arrangement. A ratio of the volume of the heating section 20 to that of the control section 21 can vary in accordance with a required resistance ratio. In the above embodiment, the front end portion of the heating section 20 is constituted by a small-diameter portion. A distance between the heating section 20 and the electrode rod 15 is short to achieve fast heating. However, the present invention is not limited to that specific distance.

As shown in FIG. 2, the preformed heating section 20 and the preformed control section 21 are prepared, and a metal ring 22 or the like is inserted therebetween. The resultant structure is baked under pressure, and the metal material is diffused to form a solid solution layer at the junction of the sections 20 and 21, thereby guaranteeing bonding therebetween. A metal coating layer 23 to be bonded to the inside of the holder 12 is formed on the outer surface of the rear end portion of the control section 21. Thereafter, the electrode rod 15 is inserted in electrode insertion holes 21*a* and 20*a* of the control and heating sections 21 and 20. The front end of the electrode rod 15 is electrically connected to the front end of the heating section 20.

The metal coating layer 23 serves to weld the heater 11 to the holder 12 by brazing or the like. A thermal expansion coefficient of the metal coating layer 23 must match that of the conductive ceramic material of the heater 11. The metal coating layer 23 is formed by a known technique such as flame spraying, CVD (Chemical Vapor Deposition), PVD (Physical Vapor Deposition) or vapor deposition. A thermal expansion coefficient of the electrode rod 15 must also match that of the conductive ceramic. Reference numeral 15*a* denotes an insulating coating layer which is formed on the front end portion of the electrode rod 15 and insulates the distal end of the rod 15 from the control section 21. The heating section 20 is electrically connected to the positive side of the battery through the external connection terminal 14, the metal wire 16 and the electrode rod 15. It is readily understood that the control section 21 is electrically connected to the negative side (ground) through the metal coating layer 23 located at the rear side.

In this embodiment, the rod heater 11 has a substantially circular cross-section. Thus, forming the rod heater 11 and mounting it in the holder 12 is simplified. However, forming and assembly of the heater 11 is not limited to this method. The rod heater may have an elliptical or a rectangular cross-section, or any other shape.

According to the rod heater 11 as described above, the heating section 20 is exposed to the outer surface of the heater, and can serve as a fast heating type plug as compared with the conventional sheath or ceramic heater type glow plug. In particular, in the above embodiment, the front end portion of the rod heater 11 is constituted by a small-diameter portion to shorten the heating time, thereby greatly improving the starting characteristics of the engine and optimizing the engine output. In the above embodiment, if an antioxide protective film is formed on the outer surface of the heater 11, the durability of the glow plug can be greatly improved.

Figure 4:
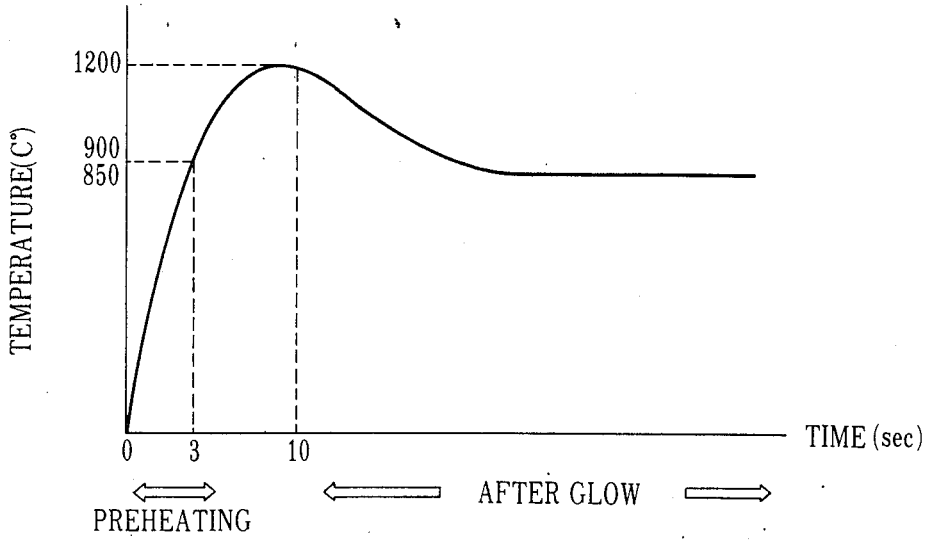
FIG. 4 is a graph showing temperature characteristics of a rod heater as the main part of the glow plug in FIG. 3.

When the heater 11 constituted by an integral body of the heating and control sections 20 and 21 of the conductive ceramic materials is used, good characteristics of the glow plug 10 can be obtained, as shown in FIG. 4. More specifically, according to a test using the glow plug 10 of this embodiment, time for heating the heater 11 to a temperature of 900° C. was 3.0 seconds, a peak temperature was about 1,200° C. when the allowable range of the peak temperature was less than 1,400° C., and a saturation temperature was 850° C.

In the self-temperature control type glow plug with the arrangement described above, when a voltage is applied from the external connection terminal 14 to the heating section 20 of the heater 11 through the metal lead wire 16 and the electrode rod 15, and to the control section 21 through the heating section 20, the applied voltage is divided by a resistance ratio of the heating section 20 to the control section 21 in the initial energization period. A higher voltage is applied to the heating section 20 since its resistance is larger than that of the control section 21. A current supplied to the heating section 20 has a larger current density than that of the control section 21, thereby quickly heating the heating section 20.

When a predetermined period of time has elapsed after starting heater energization, the control section 21 is gradually heated to increase its resistance. The voltage ratio of the heating section 20 to the control section 21 is gradually changed, and the voltage applied to the heating section 20 is decreased and controlled. When the heating section 20 is heated to the peak temperature of about 1,200° C., it is then saturated at a temperature of about 850° C., thereby preventing it from overheating. In this state, the resistance of the control section 21 is considerably larger than that of the heating section 20. The voltage applied to the heating section 20 can be limited to be below a predetermined value, due to the control function of the control section 21. Thus, even when prolonged after-glow is to be performed, the durability of the glow plug can be guaranteed.

According to the glow plug with the arrangement described above, by using the rod heater 11 including an integral body of the heating and control sections 20 and 21 of conductive ceramic materials with different positive temperature coefficients, unlike in the conventional glow plug assembly wherein a control circuit must be added to the heater circuit, the self-temperature control function can be properly performed to decrease the cost of the preheating device as a whole.

The present invention is not limited to the embodiment described above. Various changes and modifications for the shapes and structures of the respective members can be made within the spirit and scope of the invention. In the above embodiment, when the voltage is applied to the heater and control sections 20 and 21 constituting the rod heater 11, the heating section 20 is connected to the positive terminal and the control section 21 is connected to the negative terminal of the battery. However, the heating section 20 may be connected to the negative terminal and the control section 21 may be connected to the positive terminal. Furthermore, the shape and structure of the rod heater 11 and electrode connection structures can be modified.

Figure 5:
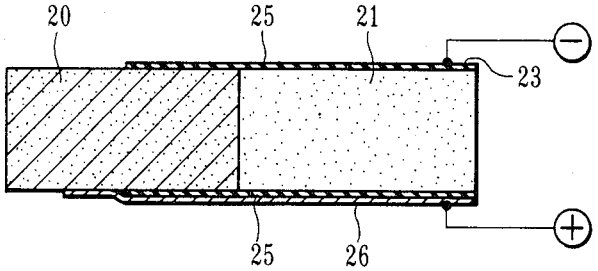
FIGS. 5 and 6 are schematic sectional views showing modifications of the rod heater in FIG. 1.
Figure 6:
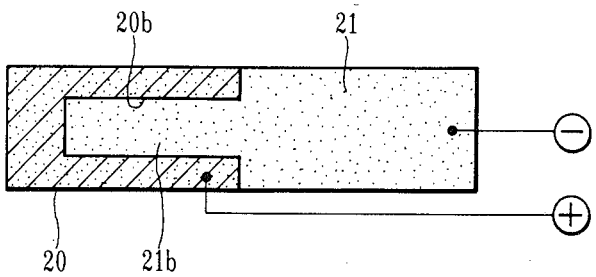

For example, as shown in FIG. 5, the rod-like heating section 20 is integrally formed with the control section 21, and a refractory insulating layer 25 is formed on the outer surface of the heating and control sections 20 and 21 except for the front end portion of the heating section 20. An electrode lead 26 is led to the heating section 20 and a negative terminal is led from a portion of the metal coating layer 23 partially formed on the outer surface of the control section 21. Furthermore, as shown in FIG. 6, a recess **20*b* is formed in the heating section 20, and a projection 21*b* fitted in the recess 20*b* is formed on the control section 21**. In this case, even if the polarities of the electrodes are reversed, no practical problems will occur.

A self-temperature control type glow plug according to another embodiment of the present invention will be described with reference to FIGS. 7 and 8. The same reference numerals in this embodiment denote the same parts as in the previous embodiment, and a detailed description thereof will be omitted.

Figure 7:
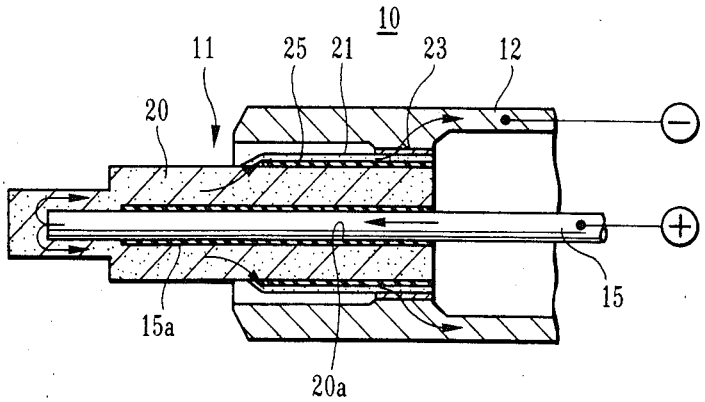
FIG. 7 is an enlarged longitudinal sectional view showing the main part of a self-temperature control type glow plug according to another embodiment of the present invention.
Figure 8:
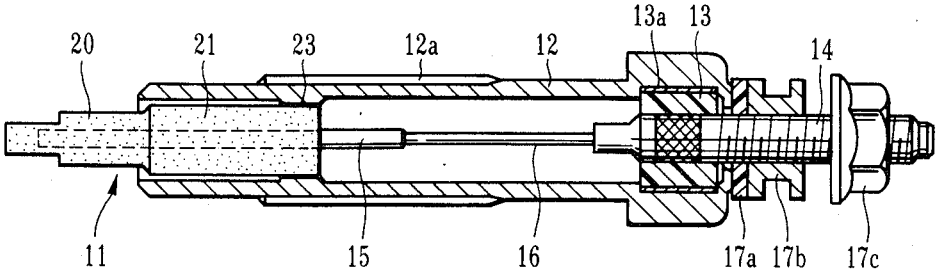
FIG. 8 is a longitudinal sectional view of the self-temperature control type glow plug in FIG. 7.

In a glow plug 10 shown in FIG. 8, a rod heater 11 held at the front end of a holder 12 includes a heating section 20 and a control section 21, as shown in FIG. 7. The heating section 20 comprises a rod member made of a conductive ceramic material with a small positive temperature coefficient. The control section 21 is made of a conductive ceramic material with a positive temperature coefficient larger than that of the heating section 20 and is formed on the rear end portion of the heating section 20 through a refractory insulating layer 25. Part of the control section 21 is electrically connected to the heating section 20. An electrode rod 15 is insulated by an insulating layer **15*a*** except for its front end portion.

According to the rod heater 11 of this embodiment, the heating section 20 is exposed to the outer surface of the heater 11 and at the same time extends inside the heater. This heater is called an inner/outer heating type heater and provides advantages over the conventional inner-heating-only type heater.

The rod heater 11 of this embodiment is prepared in the following manner. The refractory insulating layer 25 is coated on the rear end portion of the preformed heating section 20. The control section 21 is bonded onto the refractory insulating layer 25 to prepare an integral body. A metal coating layer 23 to be bonded to the holder 12 is formed on the outer surface of the rear portion of the control section 21. Subsequently, the electrode rod 15 is inserted in an electrode insertion hole **20*a* formed in the heating section 20. The front end of the electrode rod 15 is electrically connected to the front end of the heating section 20**.

In the above embodiment, the rod heater 11 has a substantially circular cross-section (the front end of the heating section is constituted by a small-diameter portion so as to achieve quick heating). Forming the rod heater 11 and mounting it in the holder 12 is thus simplified. However, forming and assembly are not limited to these. The rod heater may have an elliptical or a rectangular cross-section, or any other shape.

Figure 9:
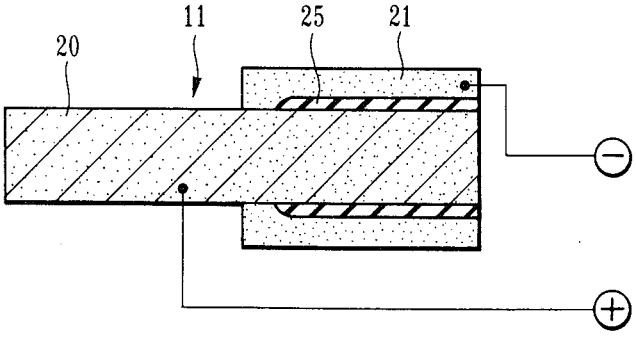
FIG. 9 is a schematic sectional view showing a modification of the rod heater in FIG. 7.

The present invention is not limited to the embodiment described above. Various changes and modifications for the shapes and structures of the respective members can be made within the spirit and scope of the invention. In the above embodiment shown in FIG. 7, when the voltage is applied to the heater and control sections 20 and 21 constituting the rod heater 11, the heating section 20 is connected to the positive terminal of the battery, and the control section 21 is connected to the negative terminal. However, as shown in FIG. 9, the heating section 20 may be connected to the negative terminal, and the control section 21 may be connected to the positive terminal. Furthermore, the shape and structure of the rod heater 11 and electrode connection structures can be modified.

A self-temperature control type glow plug according to still another embodiment of the present invention will be described with reference to FIGS. 10 and 11. The same reference numerals in this embodiment denote the same parts as in the previous embodiments, and a detailed description thereof will be omitted.

Figure 10:
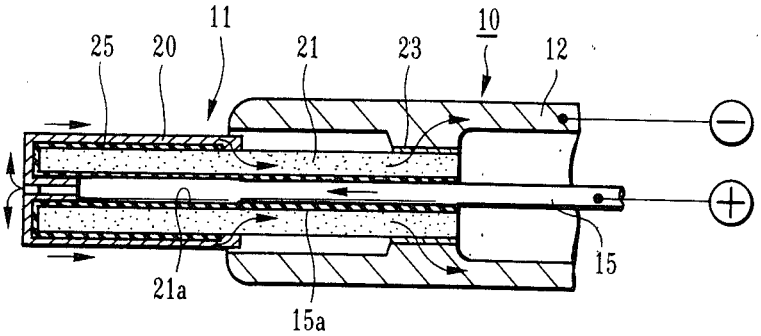
FIG. 10 is an enlarged longitudinal sectional view of a self-temperature control type glow plug according to still another embodiment of the present invention.
Figure 11:
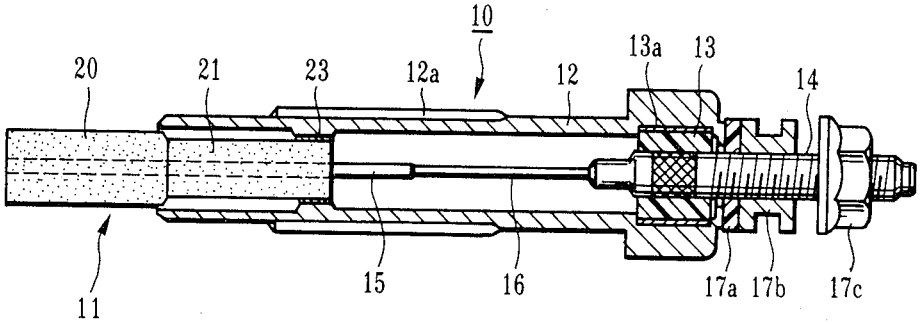
FIG. 11 is a longitudinal sectional view of the self-temperature control type glow plug in FIG. 10.

Referring to FIGS. 10 and 11, a rod heater 11 held at the front end of a holder 12 has a heating section 20 and a control section 21. The control section 21 is a rod member made of a conductive ceramic material with a large positive temperature coefficient. The heating section 20 is made of a conductive ceramic material with a positive temperature coefficient smaller than that of the control section 21 and is formed on the outer surface of the front end portion of the control section 21, through a refractory insulating layer 25. Part of the heating section 20 is electrically connected to the control section 21.

According to the rod heater 11 of this embodiment, since the heating section 20 is exposed to the outer surface of the heater, it can be called a surface heating type heater, thus providing advantages over the conventional inner heating type heater.

The rod heater 11 of this embodiment is prepared in the following manner. The refractory insulating layer 25 is coated on the outer surface of the front end portion of the preformed control section 21. The heating section 20 is coated on the refractory insulating layer 25 to obtain an integral body. A metal coating layer 23 is formed between the holder 12 and the outer surface of the rear end portion of the control section 21. Subsequently, an electrode rod 15 is inserted in an electrode insertion hole 21*a* formed in the control section 21. The front end of the electrode rod 15 is electrically connected to the front end of the heating section 20.

In the self-temperature control type glow plug 10 with the arrangement described above, a voltage is applied from an external connection terminal 14 to the heating section 10 in the heater 11 through a metal wire 16 and the electrode rod 15, and then to the control section 21.

Figure 12:
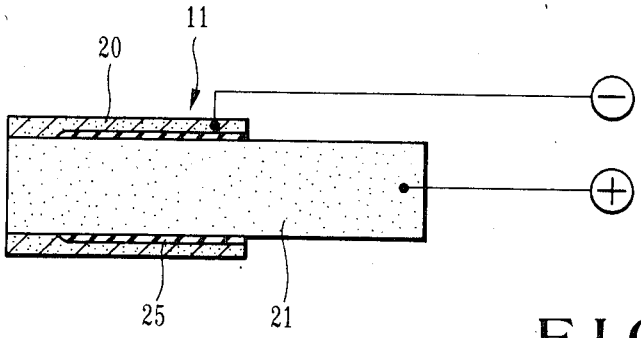
FIG. 12 is a schematic sectional view showing a modification of the rod heater in FIG. 10.

The present invention is not limited to the embodiment described above. Various changes and modifications for the shapes and structures of the respective members can be made within the spirit and scope of the invention. In the above embodiment shown in FIG. 10, when the voltage is applied to the heater and control sections 20 and 21 constituting the rod heater 11, the heating section 20 is connected to the positive terminal of the battery, and the control section 21 is connected to the negative terminal. However, as shown in FIG. 12, the heating section 20 may be connected to the negative terminal, and the control section 21 may be connected to the positive terminal. Furthermore, the shape and structure of the rod heater 11 and electrode connection structures can be modified, as shown in FIG. 12.

A self-temperature control type glow plug according to still another embodiment of the present invention will be described with reference to FIGS. 13 and 14. The same reference numerals in this embodiment denote the same parts as in the previous embodiments, and a detailed description thereof will be omitted.

Figure 13:
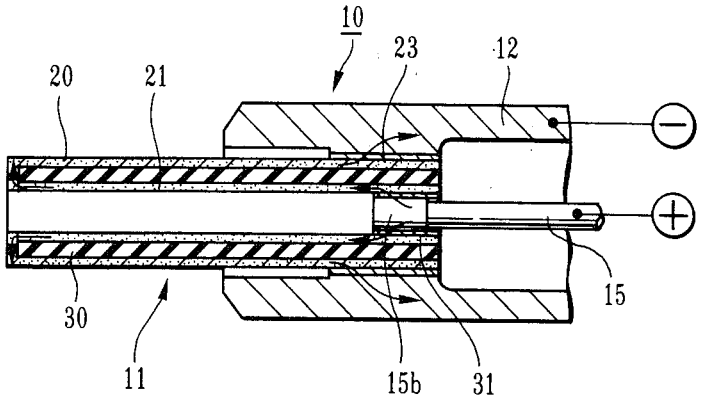
FIG. 13 is an enlarged longitudinal sectional view of a self-temperature control type glow plug according to still another embodiment of the present invention.
Figure 14:
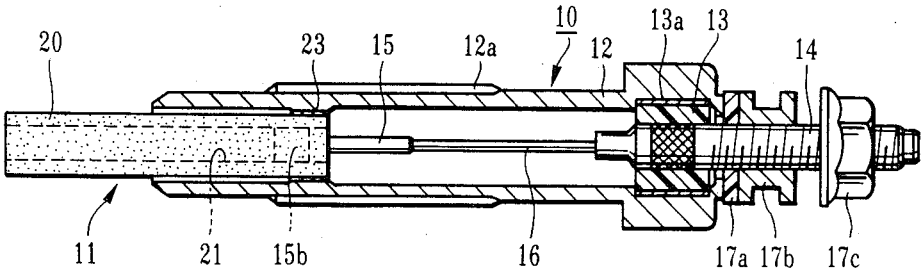
FIG. 14 is a longitudinal sectional view of the self-temperature control type glow plug in FIG. 13.

Referring to FIGS. 13 and 14, in a glow plug 10, a rod heater 11 held at the front end of a holder 12 has a heating section 20 and a control section 21. The heating section 20 is made of a conductive ceramic material with a small positive temperature coefficient and is formed on the outer surface of a refractory insulating cylinder 30. The control section 21 is made of a conductive ceramic material with a positive temperature coefficient larger than that of the heating section 20 and is formed on the inner surface of the cylinder 30. Part of the control section 21 is electrically connected to the heating section 20.

According to the rod heater 11 of this embodiment, the heating section 20 is exposed to the outer surface of the heater 11 to constitute a surface heating type heater, thus providing advantages over the conventional inner heating type heater. The refractory insulating cylinder 30 in the rod heater 11 is made of a refractory insulating material such as silicon nitride ($Si_3N_4$) or asbestos.

The rod heater 11 is prepared in the following manner. The control and heating sections 21 and 20 are respectively coated on the inner and outer surfaces of the preformed refractory insulating cylinder 30. The control section 21 is electrically connected in series with the heating section 20 at the front end of the cylinder 30 to constitute an integral body. A metal coating layer 23 is formed between the holder 12 and the outer surface of the rear end portion of the heating section 20. Similarly, a metal coating layer 31 is also formed on the surface of the rear end portion of the control section 21. An electrode rod 15 is inserted in the cylinder 30 so as to electrically connect a front end 15*b* of the electrode rod 15 to the metal coating layer 31.

With the above arrangement, the rear end portion of the control section 21 is connected to the positive terminal of the battery through an external connection terminal 14, a metal conductor 16 and the electrode rod 15. The heating section 20 is electrically connected to the holder 12 through the metal coating layer 23 located at the rear end thereof and is thus connected to the negative terminal (ground).

In the self-temperature control type glow plug with the arrangement described above, a voltage is applied from the external connection terminal 14 to the control section 21 through the metal wire 16 and the electrode rod 15, and to the heating section 20 through the control section 21.

The present invention is not limited to the embodiment described above. Various changes and modifications for the shapes and structures of the respective members can be made within the spirit and scope of the invention. In the above embodiment shown in FIG. 13, when the voltage is applied to the heating and control sections 20 and 21 constituting the rod heater 11, the heating section 20 is connected to the negative terminal and the control section 21 is connected to the positive terminal. However, the heating section 20 may be connected to the positive terminal, and the control section 21 may be connected to the negative terminal by utilizing a two-line arrangement. Furthermore, the shape and structure of the rod heater 11 and electrode connection structures can be modified.

A self-temperature control type glow plug according to still another embodiment of the present invention will be described with reference to FIGS. 15 and 16. The same reference numerals in this embodiment denote the same parts as in the previous embodiments, and a detailed description thereof will be omitted.

Figure 15:
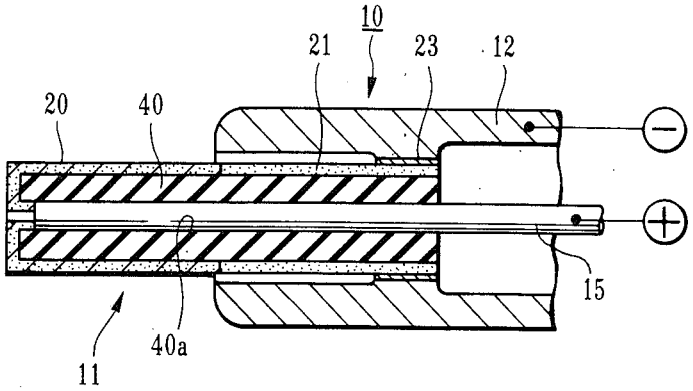
FIG. 15 is an enlarged longitudinal sectional view of a self-temperature control type glow plug according to still another embodiment of the present invention.
Figure 16:
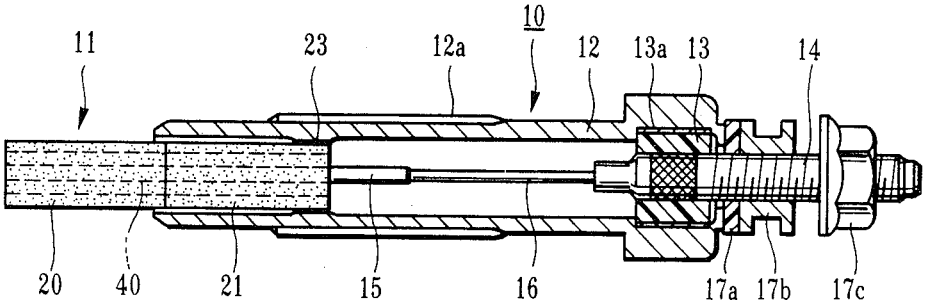
FIG. 16 is a longitudinal sectional view of the self-temperature control type glow plug in FIG. 15.

Referring to FIGS. 15 and 16, in a glow plug 10, a rod heater 11 held at the front end of a holder 12 has a heating section 20 and a control section 21. The heating section 20 is made of a conductive ceramic material with a small positive temperature coefficient and is formed on the outer surface of the front end portion of a refractory insulating body 40. The control section 21 is made of a conductive ceramic material with a positive temperature coefficient larger than that of the heating section 20 and is formed on the outer surface of the rear end portion of the refractory insulating body 40. The control section 21 is electrically connected to the heating section 20.

According to the rod heater 11 of this embodiment, the heating section 20 is exposed to the outer surface of the heater 11 to constitute a surface heating type heater, thus providing advantages over the conventional inner heating type heater. The refractory insulating body 40 in the rod heater 11 is made of a refractory insulating material such as silicon nitride ($Si_3N_4$) or asbestos.

The rod heater 11 of this embodiment is prepared in the following manner. The heating and control sections 20 and 21 are coated on the surfaces of the front and rear portions of the preformed rod-like refractory insulating body 40, respectively. The heating and control sections 20 and 21 are connected at the center of the insulating body 40 along its longitudinal direction, thereby obtaining an integral body. A metal coating layer 23 is formed between the holder 12 and the outer surface of the rear end portion of the control section 21. An electrode rod 15 is inserted in an electrode insertion hole 40*a* formed in the insulating body 40, and the front end of the electrode rode 15 is electrically connected to the heating section 20.

According to the glow plug of this embodiment, the front end of the heating section 20 is connected to the positive terminal through an external connection terminal 14, a metal wire 16 and the electrode rod 15. The control section 21 is electrically connected to the holder 12 through the metal coating layer 23 formed at the rear end portion thereof and hence to the negative terminal (ground).

In the self-temperature control type glow plug with the arrangement described above, a voltage is applied from the external connection terminal 14 to the heating section 20 in the heater 11 through the metal wire 16 and the electrode rod 15, and to the control section 21 through the heating section 20.

The present invention is not limited to the embodiment described above. Various changes and modifications for the shapes and structures of the respective members can be made within the spirit and scope of the invention. In the above embodiment shown in FIG. 15, when the voltage is applied to the heater and control sections 20 and 21 constituting the rod heater 11, the heating section 20 is connected to the negative terminal, and the control section 21 is connected to the positive terminal. However, the heating section 20 may be connected to the positive terminal, and the control section 21 may be connected to the negative terminal. Furthermore, the shape and structure of the rod heater 11 and electrode connection structures can be modified as follows.

Figure 17:
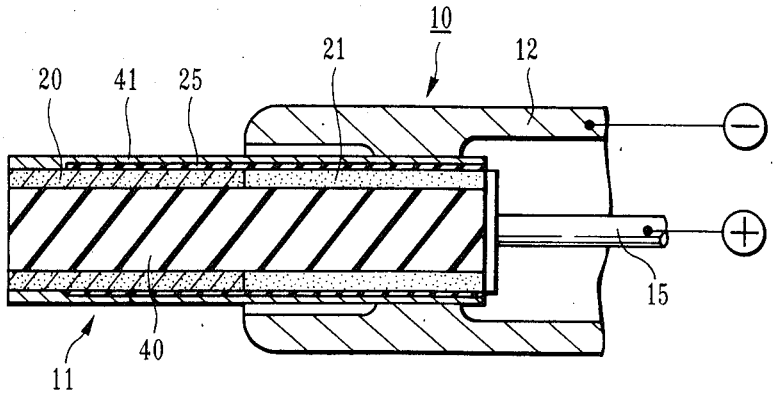
FIGS. 17 to 19 are schematic sectional views showing modifications of the rod heater in FIG. 15.

As shown in FIG. 17, a round rod is used as the refractory insulating body 40, and the heating and control sections 20 and 21 are consecutively formed on the outer surface of the insulating body 40. An electrode lead layer 41 from the heating section 20 is formed on the outer surface of the structure through a refractory insulating layer 25 and is connected to the holder 12. The electrode rod 15 is connected to the rear end face of the control section 21.

Figure 18:
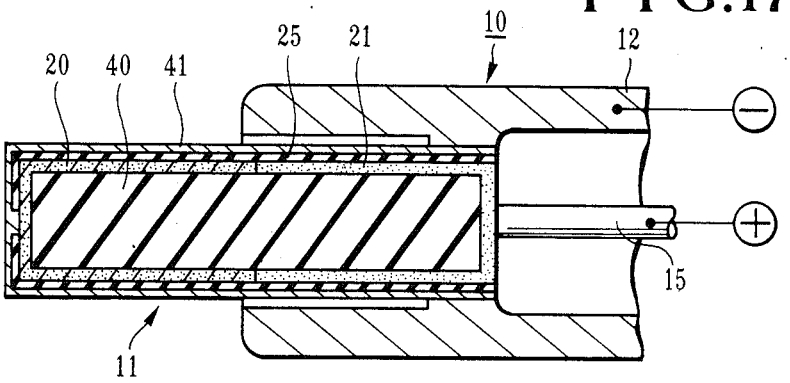

As shown in FIG. 18, the heating section 20 and the control section 21 extend to the front and rear end faces of the refractory insulating body 40, respectively. The heating section 20 is connected to the holder 12 through the electrode lead layer 41, and the control section 21 is connected to the electrode rod 15 in the same manner as in FIG. 17.

Figure 19:
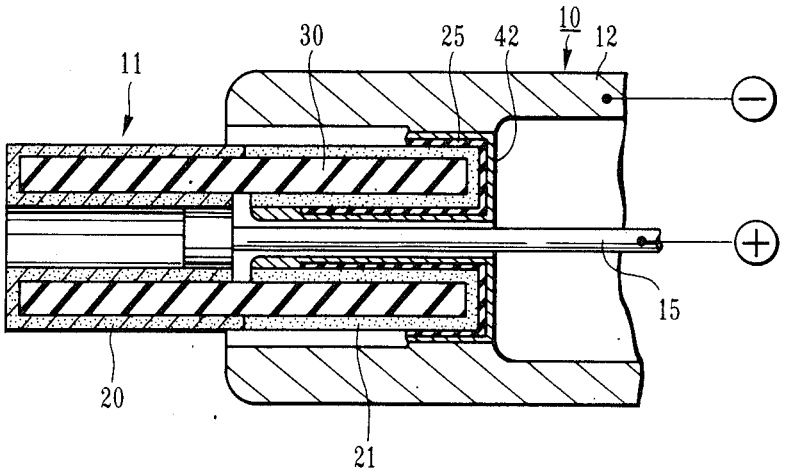

As shown in FIG. 19, a refractory insulating cylinder 30 is used as a base for forming the heating and control sections 20 and 21. The heating section 20 is formed on the inner and outer surfaces of the front end portion of the cylinder 30. The control section 21 is formed on the inner and outer surfaces of the rear end portion of the cylinder 30. The heating section 20 and the control section 21 are connected to each other on the outer surface of the cylinder 30. The heating section 20 is insulated from the control section 21 on the inner surface of the cylinder 30. In this modification, the front end of the electrode rod 15 is connected to the inner edge of the heating section 20 within the cylinder 30. At the same time, an electrode lead layer 42 led from the inner edge of the control section 21 within the cylinder 30 to the outer surface through the refractory insulating layer 25 is connected to the holder 12. With this arrangement, the resistances of the heating and control sections 20 and 21 can be increased, thus providing design flexibility and hence obtaining a glow plug with higher performance.

According to the self-temperature control type glow plug of the present invention, a rod heater held at the front end of a holder includes a heating section and a control section. The heating section is formed by a conductive ceramic material with a small positive temperature coefficient at the front end portion of the holder, and the control section is formed by a conductive ceramic material with a positive temperature coefficient larger than that of the heating section at the rear portion of the holder. The control section is integrally formed with the heating section. Thus, a simple glow plug can be manufactured at low cost. The self-temperature control function of the power control section of the integral body formed by the heating and control sections provides the following advantages. The heater can be quickly heated as compared with the conventional glow plugs and provides high performance. The quick heating function of the heater can be improved. Heat-resistance characteristics for the high-temperature operating conditions can be improved. In addition, the starting characteristics of the engine and heating characteristics such as overshooting can be greatly improved. Therefore, the long-period after-glow effect for reducing the amount of exhaust gas and noise from the engine can be achieved. Furthermore, the overall structure of the glow plug and its assembly can be simplified. Heat-resistance and durability of the glow plug under severe operating conditions can be improved.

According to a self-temperature control type glow plug of the present invention, a rod heater held at the front end of a holder includes a heating section and a control section. The heating section is a rod member made of a conductive ceramic material with a small positive temperature coefficient. The control section is made of a conductive ceramic material with a positive temperature coefficient larger than that of the heating section and is formed at the rear end face of the heating section through a refractory insulating layer. Part of the control section is electrically connected to the heating section, thus providing a simple glow plug at low cost. With this arrangement, the advantages described above can also be obtained.

According to another self-temperature control type glow plug of the present invention, a rod heater held at the front end of the holder includes a heating section and a control section. The control section is a rod member made of a conductive ceramic material with a large positive temperature coefficient. The heating section is made of a conductive ceramic material with a positive temperature coefficient smaller than that of the control section and is formed at the front end face of the control section through a refractory insulating layer. Part of the heating section is electrically connected to the control section, thus providing a simple glow plug at low cost. With this arrangement, the advantages described above can also be obtained.

According to still another self-temperature control type glow plug of the present invention, a rod heater held at the front end of a holder includes a heating section and a control section. The heating section is made of a conductive ceramic material with a small positive temperature coefficient and is formed on the outer surface of a refractory insulating cylinder. The control section is made of a conductive ceramic material with a positive temperature coefficient larger than that of the heating section and is formed on the inner surface of the cylinder. Part of the control section is electrically connected to the heating section, thus providing a simple glow plug at low cost. With this arrangement, the advantages described above can also be obtained.

According to still another self-temperature control type glow plug of the present invention, a rod heater held at the front end of a holder includes a heating section and a control section. The heating section is made of a conductive ceramic material with a small positive temperature coefficient and is formed on the inner and outer surfaces of the front portions of a refractory insulating body. The control section is made of a conductive ceramic material with a positive temperature coefficient larger than that of the heating section and is formed on the inner and outer surfaces of the rear end portion of the refractory insulating body, thus providing a simple glow plug at low cost. With this arrangement, the advantages described above can also be obtained.

What is claimed is:

1. A self-temperature control type glow plug comprising a rod heater held at a front end of a hollow metal holder and having one end extending outside said hollow metal holder, said rod heater including a heating section made of a conductive ceramic material with a small positive temperature coefficient and a control section made of a conductive ceramic material with a positive temperature coefficient larger than that of said heating section, said heating section being formed integrally with said control section.

2. A plug according to claim 1, wherein said heating section is located at a front end side of said rod heater, and said control section is located at a rear end side thereof.

3. A plug according to claim 1, wherein an electrode rod is guided in said heating section through said control section, a portion of said electrode rod which extends through said control section is insulated from said control section through an insulating material, said control section is connected to an external source through said metal holder, and said electrode rod is connected to an external connection terminal through said metal holder.

4. A plug according to claim 1, wherein said heating section has a small cross-sectional area at least at a front end portion thereof.

5. A plug according to claim 1, wherein said heating section has a rod-like shape, said control section is formed on an outer surface of a rear end portion of said heating section through a refractory insulating layer, and said heating section is partially electrically connected to said control section.

6. A plug according to claim 5, wherein an electrode rod is guided in said heating section through said heating section, a portion of said electrode rod which extends through said heating section, except for a front end portion of said electrode rod, is insulated from said heating section through an insulating material, said control section is connected to an external source through said metal holder, and said electrode rod is connected to an external connection terminal through said metal holder.

7. A plug according to claim 5, wherein said heating section has a relatively small cross-sectional area at least at a front end portion thereof.

8. A plug according to claim 1, wherein said control section has a rod-like shape, said heating section is formed on an outer surface of a front end portion of said control section through a refractory insulating layer, and said heating section is partially electrically connected to said control section.

9. A plug according to claim 8, wherein said heating section is formed on a front end face of said control section through a refractory insulating layer, an electrode rod is guided in said control section through said control section and is isolated from said control section through an insulating material, a front end of said electrode rod is connected to said heating section, said control section is connected to an external source through said metal holder, and said electrode rod is connected to an external connection terminal through said metal holder.

10. A plug according to claim 1, wherein said heating section is formed on an outer surface of a refractory insulating cylinder, said control section is formed on an inner surface of said refractory insulating cylinder, and said heating section and said control section are electrically connected at a front end of said refractory insulating cylinder.

11. A plug according to claim 10, wherein said heating section is connected to an external source through said metal holder, said control section is connected to an electrode rod, and said electrode rod is connected to an external connection terminal through said metal holder.

12. A plug according to claim 10, wherein said refractory insulating cylinder comprises an insulating ceramic member.

13. A plug according to claim 1, wherein said heating section is formed at a front end portion of a refractory insulating rod, said control section is formed at a rear end portion of said refractory insulating rod, and said control section is electrically connected to said heating section.

14. A plug according to claim 13, wherein said control section is connected to an external source through said metal holder, an electrode rod extends through said refractory insulating rod, a front end of said electrode rod is connected to said heating section, and said electrode rod is connected to an external connection terminal through said metal holder.

15. A plug according to claim 13, wherein said heating section is connected to an external source through said metal holder, and said control section is connected to an external connection terminal through said electrode rod arranged inside said metal holder.

16. A plug according to claim 15, wherein a refractory insulating layer is formed on said control section and said heating section, and a front end of said heating section is connected to said metal holder through a conductive layer formed on said refractory insulating layer.

17. A plug according to claim 13, wherein said insulating rod comprises an insulating ceramic member.

18. A plug according to claim 1, wherein said heating section is formed on an outer surface of a front end portion, a front end face, and an inner surface of said front end portion, of a refractory insulating cylinder; said control section is formed on an outer surface of a rear end portion, a rear end face, and an inner surface of said rear end portion, of said refractory insulating cylinder; said heating section is electrically connected to said control section on said outer surface of said cylinder; and said heating section is insulated from said control section on said inner surface of said cylinder.

19. A plug according to claim 18, wherein said refractory insulating cylinder comprises an insulating ceramic member.

20. A plug according to claim 19, wherein said control section is connected to an external source through said metal holder, said heating section is connected to said electrode rod arranged inside said cylinder, and said electrode rod is connected to an external connection terminal through said metal holder.

* * * * *